US010391508B2

(12) United States Patent
White

(10) Patent No.: US 10,391,508 B2
(45) Date of Patent: Aug. 27, 2019

(54) CONTAINER FOR NESTED SPRAYER HANDLE

(71) Applicant: Silgan Plastics LLC, Chesterfield, MO (US)

(72) Inventor: Edmund Lee White, Johns Creek, GA (US)

(73) Assignee: Silgan Plastics LLC, Chesterfield, MO (US)

( * ) Notice: Subject to any disclaimer, the term of this patent is extended or adjusted under 35 U.S.C. 154(b) by 37 days.

(21) Appl. No.: 15/638,050

(22) Filed: Jun. 29, 2017

(65) Prior Publication Data

US 2019/0001356 A1 Jan. 3, 2019

(51) Int. Cl.

| | |
|---|---|
| ***B05B 9/04*** | (2006.01) |
| ***B05B 11/00*** | (2006.01) |
| ***B05B 15/62*** | (2018.01) |
| ***B05B 15/63*** | (2018.01) |

(52) U.S. Cl.

CPC ..... *B05B 11/0037* (2013.01); *B05B 9/0426* (2013.01); *B05B 11/0056* (2013.01); *B05B 15/62* (2018.02); *B05B 15/63* (2018.02); *B05B 11/00* (2013.01); *B05B 11/3057* (2013.01)

(58) Field of Classification Search

CPC ..... A01M 7/0046; B05B 9/01; B05B 9/0426; B05B 11/0008; B05B 11/0037; B05B 11/0038; B05B 11/3057; B05B 15/60; B05B 15/62; B05B 15/63; B65D 25/2882–2897

See application file for complete search history.

(56) References Cited

U.S. PATENT DOCUMENTS

| | | | | | |
|---|---|---|---|---|---|
| 2,516,728 | A * | 7/1950 | Smith | B65D 25/42 | 220/768 |
| 4,392,594 | A * | 7/1983 | Swett | A01G 25/14 | 222/530 |
| 4,412,633 | A * | 11/1983 | Guerrazzi | B65D 1/20 | 215/398 |
| 5,050,757 | A * | 9/1991 | Hidding | B65D 21/0237 | 215/383 |
| 5,469,993 | A * | 11/1995 | Hauf | B05B 9/0426 | 222/383.3 |
| D380,148 | S * | 6/1997 | Hauf | D9/528 | |
| 6,367,665 | B1 * | 4/2002 | Barriac | B05B 9/0426 | 222/383.1 |
| 6,508,410 | B1 | 1/2003 | Thomas, Jr. et al. | | |
| D494,069 | S * | 8/2004 | Mayne | D9/528 | |
| 7,607,556 | B2 | 10/2009 | Engelen | | |
| 2002/0125341 | A1 * | 9/2002 | Perkitny | A01G 25/145 | 239/332 |

* cited by examiner

*Primary Examiner* — Nicholas J. Weiss

(74) *Attorney, Agent, or Firm* — Reinhart Boerner Van Deuren s.c.

(57) ABSTRACT

An improved container suitable for use with a nesting sprayer handle is provided. The container includes a container handle opening with an improved top wall geometry. The top wall geometry resists deformation to reduce or eliminate accidental dislodgment of a sprayer handle when the sprayer handle is nested in the container handle opening.

22 Claims, 8 Drawing Sheets

CONTAINER FOR NESTED SPRAYER HANDLE

FIELD OF THE INVENTION

This invention generally relates to a container having a nested sprayer handle. More specifically, this invention relates to an arch and ramp to stiffen the handle opening of a liquid container to secure the sprayer handle therein.

BACKGROUND OF THE INVENTION

Bulk liquid containers including a trigger-actuated sprayer handle are used for a variety of applications, such as weed control application, insecticides, etc. In some applications, the spray handle is nested within the carrying handle opening of the bulk container during shipping and retail sale. When a user desires to employ the spray handle, the spray handle is removed from the nested position and affixed to the container opening via a length of flexible tubing. Such containers are disclosed, for example, in U.S. Pat. No. 6,367,665, and an embodiment is depicted in FIG. 1 (prior art).

In many such designs, the spray handle is prone to accidental dislodgment from the carrying handle area of the bulk container during manufacture, shipping, retail sale, and/or transport and storage by a user. Some attempts to secure such sprayer handle within the carrying handle opening have provided further securement of the spray handle in the via an adhesive and/or a tie (zip tie, twisted wire, etc.). However, these securement methods add additional expense and are cumbersome. Furthermore, an attachment without requirement of an adhesive or tie is preferable in order that the spray handle may be repeatably snapped into and secured in the carrying handle area without additional parts or effort.

In snap-fit embodiments, the carrying handle area of the bulk container is typically provided with one or more snap beads to provide a snug snap fit for a sprayer handle having complementary recesses. Unfortunately, it has been observed that such embodiments loosen over time. It is hypothesized that product loss from within the container and/or container deformation (for example, outward creep of container side walls) causes the snap-fit area to loosen and thereby release the sprayer handle.

The invention provides such an improved container and nested sprayer handle. These and other advantages of the invention, as well as additional inventive features, will be apparent from the description of the invention provided herein.

BRIEF SUMMARY OF THE INVENTION

In one aspect, the invention provides a container. The container includes container walls defining an internal volume and a center plane. The container also includes a top wall with a first side and a second side positioned on opposite sides of the center plane. The first side and second side each have a generally planar surface. The first side includes an arched panel. The container also includes a container handle, such that the top wall and container handle define a handle opening. The handle opening is configured to receive and mechanically secure a sprayer handle.

In some embodiments, the arched panel extends above the generally planar surface of the first side proximate to the center plane. Additionally, the second side may include a transverse wedge on the second side. The transverse wedge extends from the center plane to a second side wall. The transverse wedge extends a first height above the generally planar surface of the second side, at a portion of the transverse wedge at a location proximate to the center plane. In a further embodiment, the transverse wedge extends a second height above the generally planar surface of the second side proximate to the second side wall. The second height is less than the first height, and the second height may be the same height as the generally planar surface of the second side.

In some embodiments, the arched panel extends above the generally planar surface of the first side by about 0.2 inches to 0.5 inches, when measured at a location proximate to the center plane.

In some embodiments, the container walls include a front wall, side walls, and a back wall, wherein the front wall, side walls, and back wall are generally symmetrical about the center plane. In other embodiments, some or all of the front wall, side walls, and a back wall need not be symmetrical.

In some embodiments, the container may include a transverse wedge on the second side, the transverse wedge extending from the center plane to a side wall.

In some embodiments, the container may include mechanical engagement portions, such as a lower snap lug and an upper snap lug. The lower snap lug and upper snap lug may be configured to engage a sprayer handle and mechanically secure the sprayer handle within the container handle opening. In typical embodiments, snap lugs on the container engage corresponding recess of the sprayer handle. In some embodiments, the upper and lower snap lugs are positioned on the center plane. In other embodiments, the upper and lower snap lugs are vertically aligned.

In another aspect, the invention provides a dispensing system. The dispensing system includes a container with walls defining an internal volume. The walls include a top wall having a generally planar surface. The top wall has an annular opening in the top wall for accessing the contents of the container. The container also includes a container handle, such that the top wall and container handle define a container handle opening. The top wall has an arched portion extending above the generally planar surface. The dispensing system further includes a sprayer handle assembly. The sprayer handle assembly is selectively securable to the container within the container handle opening, and to the annular opening.

In some embodiments, the dispensing system includes a cylindrical recess extending below the generally planar surface of the top wall.

In some embodiments, the container handle opening includes a first mechanical engagement portion and a second mechanical engagement portion. In a typical embodiment, the first mechanical engagement portion and a second mechanical engagement portion are snap lugs or recesses. In such embodiments, the sprayer handle may have a third mechanical engagement portion configured to engage the first mechanical engagement portion, and a fourth mechanical engagement portion configured to engage the second mechanical engagement portion.

In further such embodiments, the container include a center plane, and the first mechanical engagement portion may be positioned at the center plane. Additionally, the second mechanical engagement portion may be positioned at the center plane.

In yet another aspect, the invention provides a method for dispensing a product. The method includes providing a container with a container handle opening. The container handle opening includes a center plane and at least a first mechanical engagement portion. The container also includes a top wall with a generally planar surface, and an arched portion extending above the generally planar surface. The arched portion is provided on a first side of the center plane. The top wall also includes a transverse wedge portion on a second side of the center plane. The method also includes the step of providing a sprayer assembly. The sprayer assembly includes at least a second mechanical engagement portion configured to engage the first mechanical engagement portion. The method also includes the step of removably coupling the sprayer assembly to the container handle opening.

In some embodiments, the method also includes the step of filling the container with a liquid.

In some embodiments, the step of removably coupling the sprayer assembly to the container handle opening does not use a fastener or adhesive.

In some embodiments, the step of removably coupling the sprayer assembly to the container handle opening engages the first mechanical engagement portion to the second mechanical engagement portion. In such embodiments, the first and second mechanical engagement portions may comprise a protrusion and a complimentary recess.

Other aspects, objectives and advantages of the invention will become more apparent from the following detailed description when taken in conjunction with the accompanying drawings.

BRIEF DESCRIPTION OF THE DRAWINGS

The accompanying drawings incorporated in and forming a part of the specification illustrate several aspects of the present invention and, together with the description, serve to explain the principles of the invention. In the drawings.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

Figure 1:
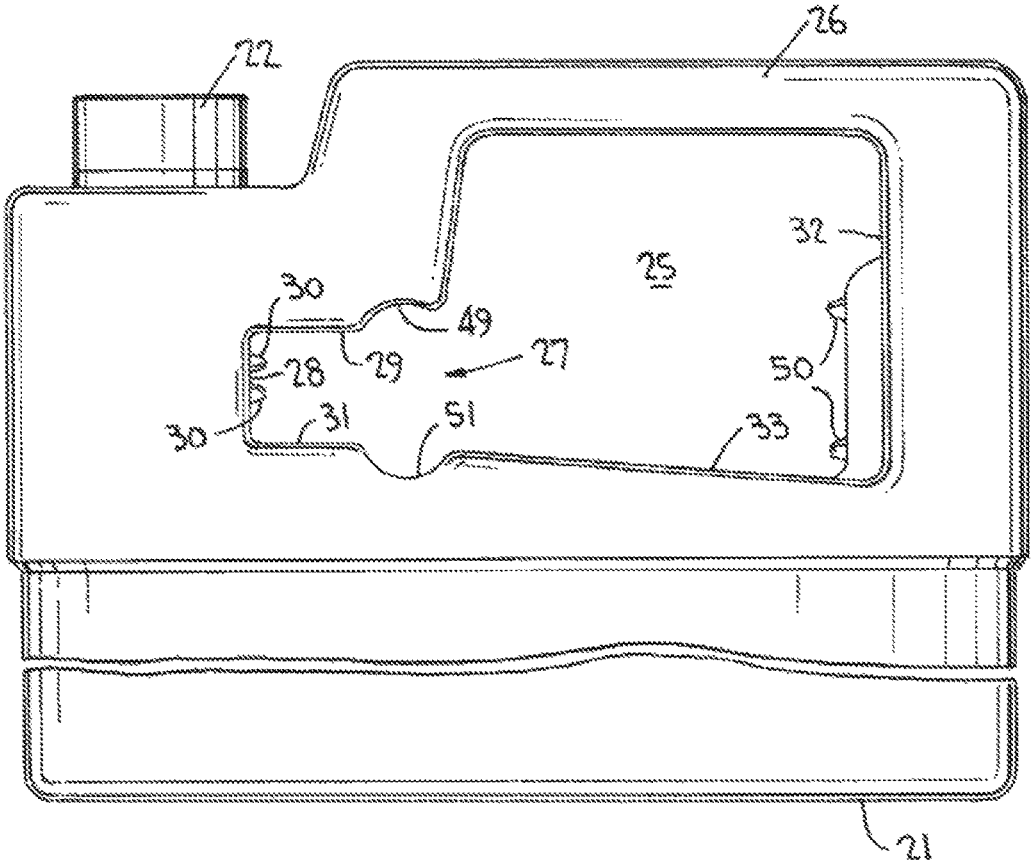
Fig. 1 (prior art)
FIG. 1 is a depiction of a prior art embodiment of a container suitable for use with a nested spray handle.
Figure 2:
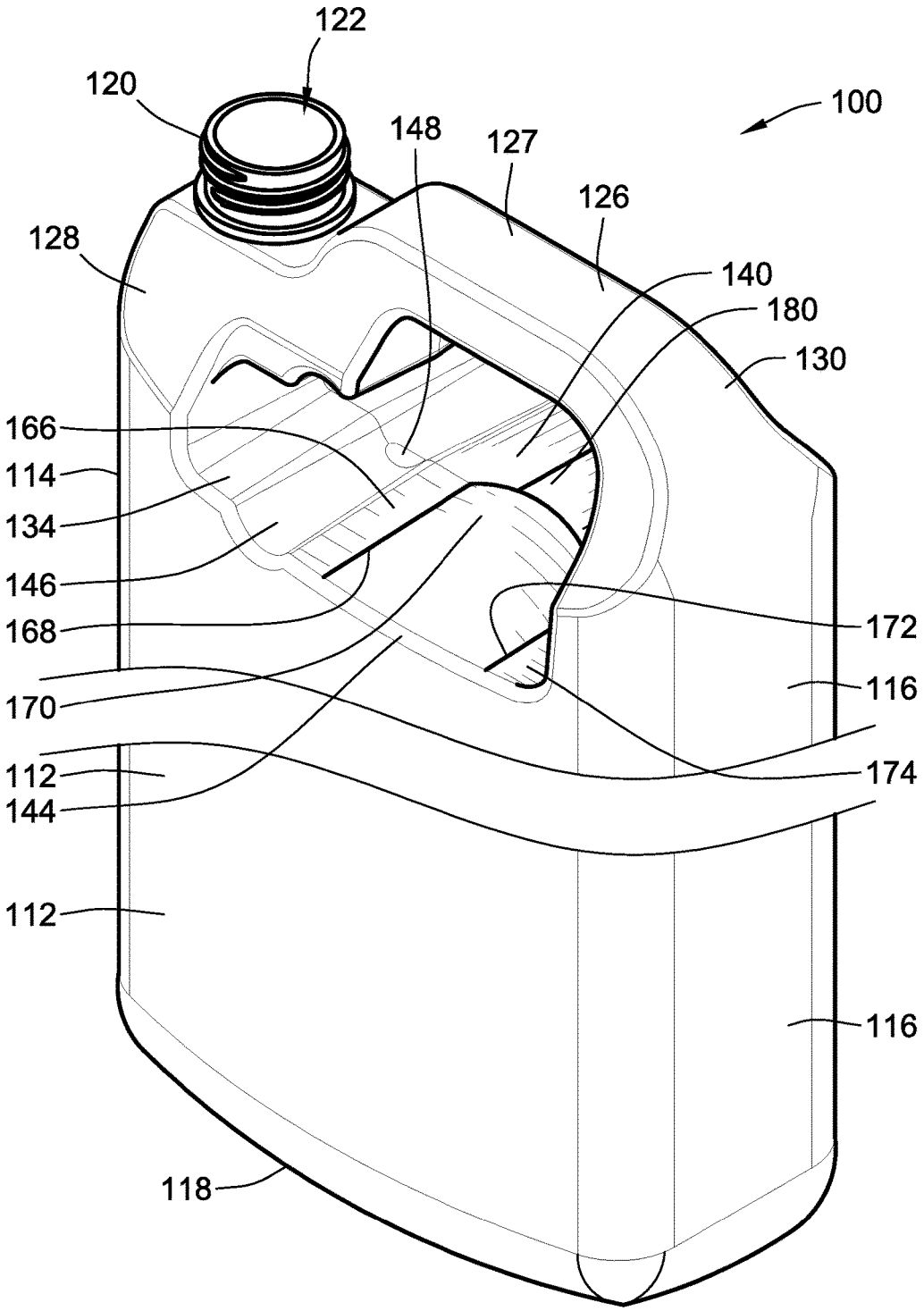
FIG. 2 is a perspective view of a container including an embodiment of the present invention, viewed from the left side.
Figure 3:
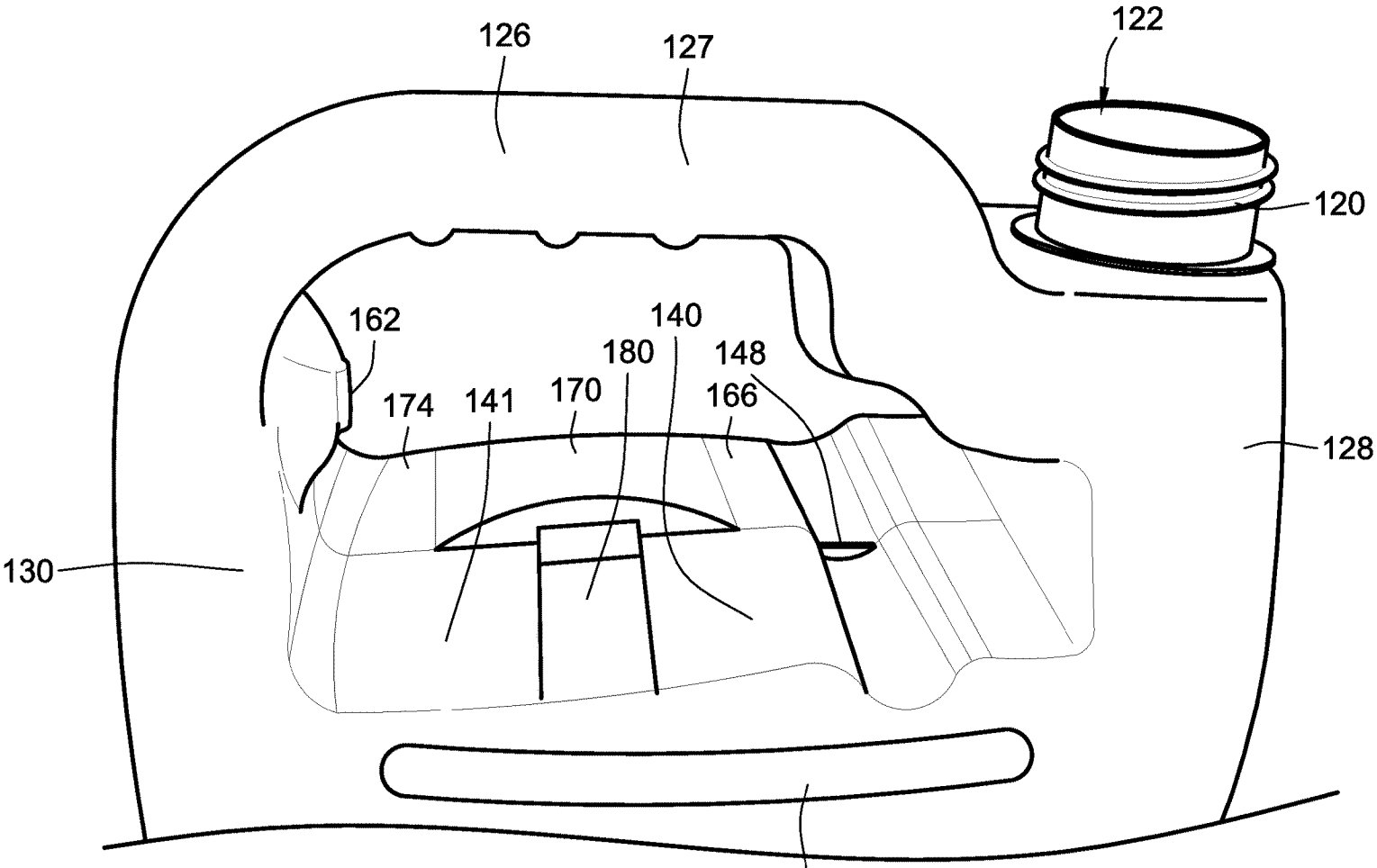
FIG. 3 is a perspective view of a container including an embodiment of the present invention, viewed from the right side.
Figure 4:
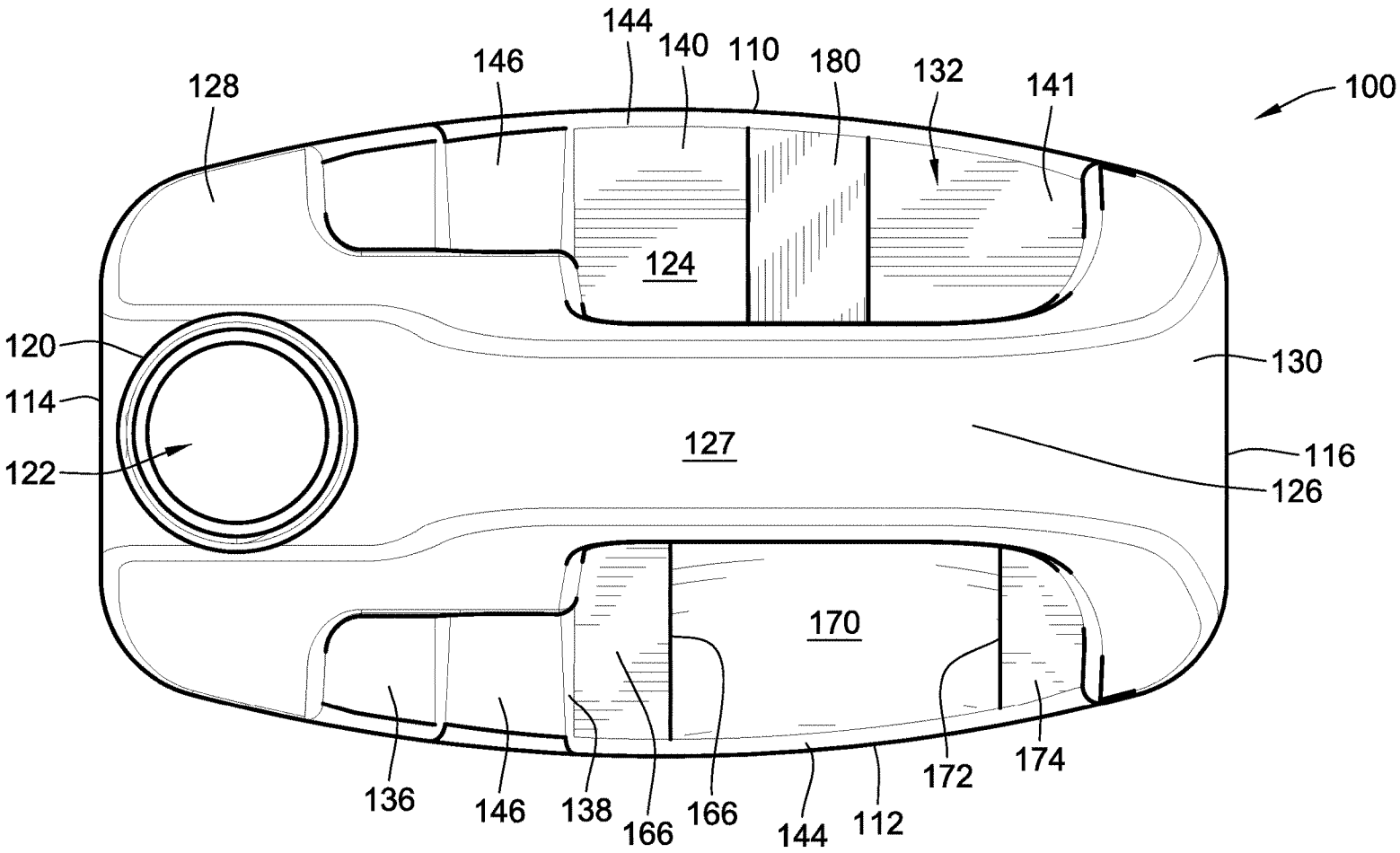
FIG. 4 is a top plan view of a container including an embodiment of the present invention.

Referring to FIG. 1, a prior art embodiment of a container for use with a nested sprayer handle is shown. Generally, a sprayer handle (not shown) may be secured between lugs 30, 50 within opening 25. However, flat panel 33 is prone to deformation, particularly downward flexure, causing undesirable dimensional changes to opening 25. Such dimensional changes to opening 25 typically cause the sprayer handle to loosen when in a stored position, and thereby result in dislodgment of the sprayer handle in shipment, retail locations, or during use.

Referring to FIGS. 2-8, a bulk container 100 according to the present invention is shown. Bulk container 100 includes side walls 110 and 112, front wall 114, rear wall 116, a bottom wall 118, and a top wall 124. The walls of bulk container 100 collectively define an interior volume of the container. In the embodiment shown, front and rear walls 114, 166 are generally planar, while side walls 110, 120 are provided with a moderate curvature. In other embodiments, each of walls 110, 112, 114, and 116 may include any combination of generally planar and generally curved walls.

In the embodiment shown, container 100 is generally symmetrical about the center plane, that is, the plane defined by the intersection of center lines 150, 152, with the exception of some features of top wall 124. In other embodiments, additional features of top surface 124 and/or other portions of container 100 may be asymmetric about the center plane to accommodate, for example, different configurations of a sprayer handle 200. It will be additionally appreciated by those of skill in the art that references to "right" and "left in the description below may be mirrored without changing the inventive aspects of the container 100.

As shown, bulk container 100 includes a top wall 124 and a carrying handle 126. Carrying handle 126 includes a horizontal handle portion 127, front riser 128, and rear riser 130. In a typical embodiment, horizontal handle portion 127, front riser 128, and rear riser 130 of carrying handle 126 are hollow and in fluid communication with the interior volume of bulk container 100. Top wall 124 and carrying handle 126 together define a carrying handle opening 132. A threaded neck portion 120 defining an annular product opening 122 provides access to the interior volume of bulk container 100. As shown, threaded neck portion 120 is provided on front riser 128.

In various typical embodiments, container 100 is a plastic. In one preferred embodiment, container 100 is formed from extruded high density polyethylene (HDPE) having an average wall thickness of about 1.0 millimeter. In other embodiments, container 100 may be formed from any extrudable blow-molded material, such as Polypropylene (PP), nylon, Polyvinyl Chloride (PVC), and Polyethylene Terephthalate (PET), and having an average wall thickness of 0.6 to 2.0 millimeters.

In various embodiments, container 100 may have an effective internal volume of between 0.5 gallons to 5 gallons, preferably between about 1 gallon and 2.5 gallons. Particularly preferred embodiments of container 100 include an effective internal volume of about 1 gallon, 2 gallons, or 2.5 gallons. By "effective internal volume" it is meant the nominal storage capacity of a liquid within container 100 to a fill line that is below the level of product opening 122.

Referring now to FIGS. 3-7, the top wall 124 of container 100 is divided in to discrete areas to reduce or eliminated downward paneling or saddling of top wall 124 in response to a reduced pressure in the interior volume of a container 100. Such reduced pressure may result from evaporative product loss from within container 100, changes in temperature of the contents or environment of container 100, or withdrawal of the contents of container 100 via a sprayer handle 200 (shown in FIG. 8).

Figure 5:
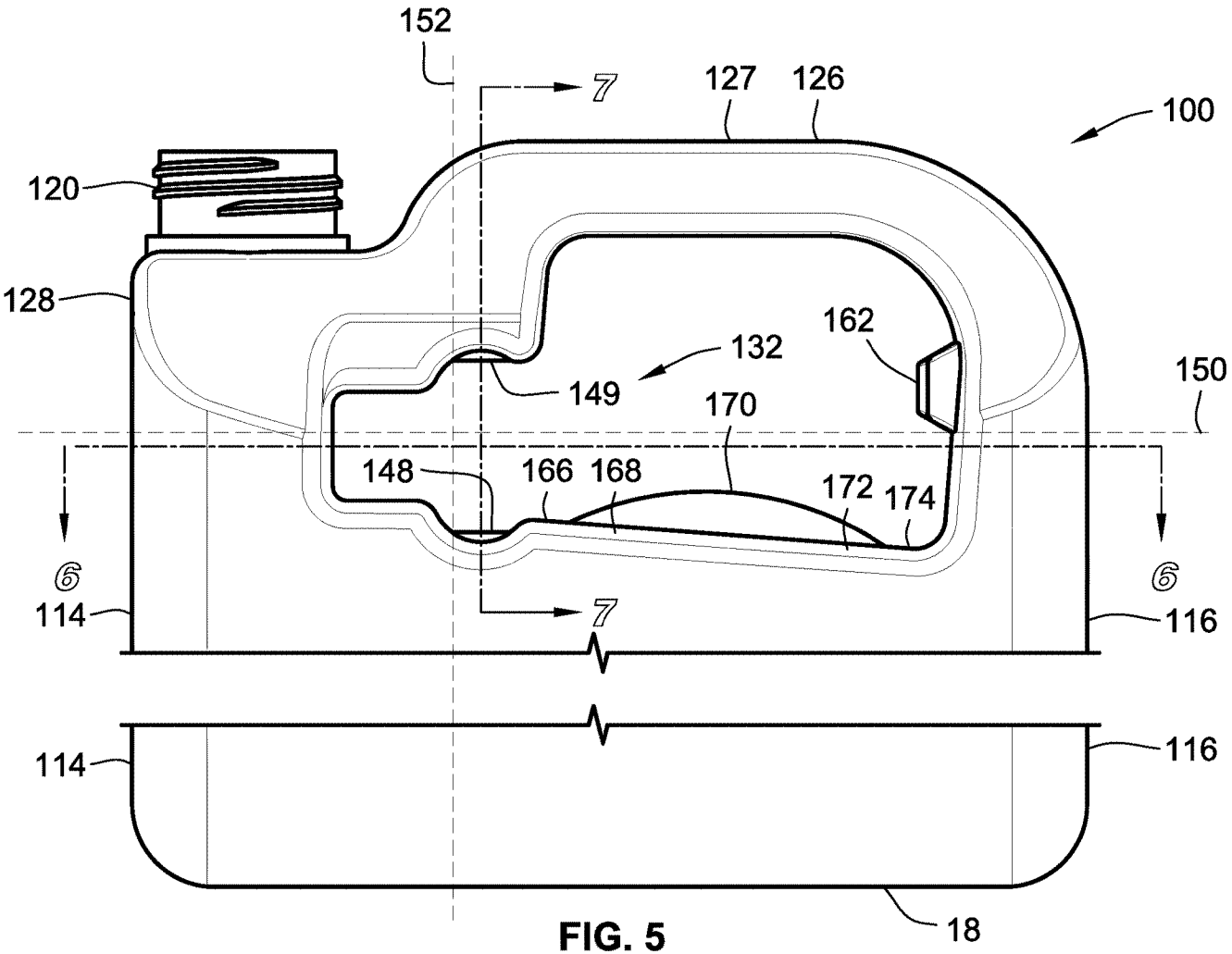
FIG. 5 is a side elevation view of a container including an embodiment of the present invention.
Figure 6:
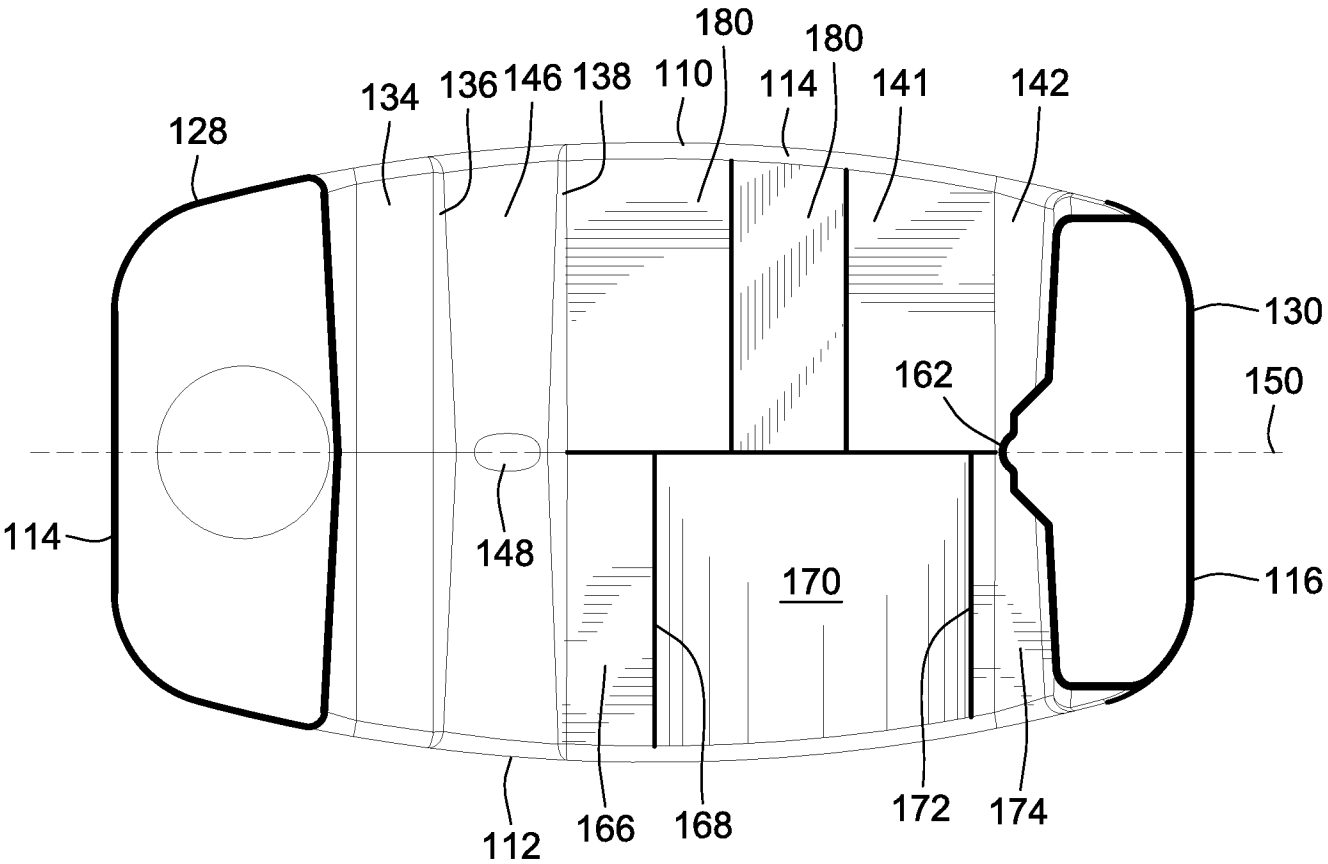
FIG. 6 is a top cross-sectional view of a container including an embodiment of the present invention.
Figure 7:
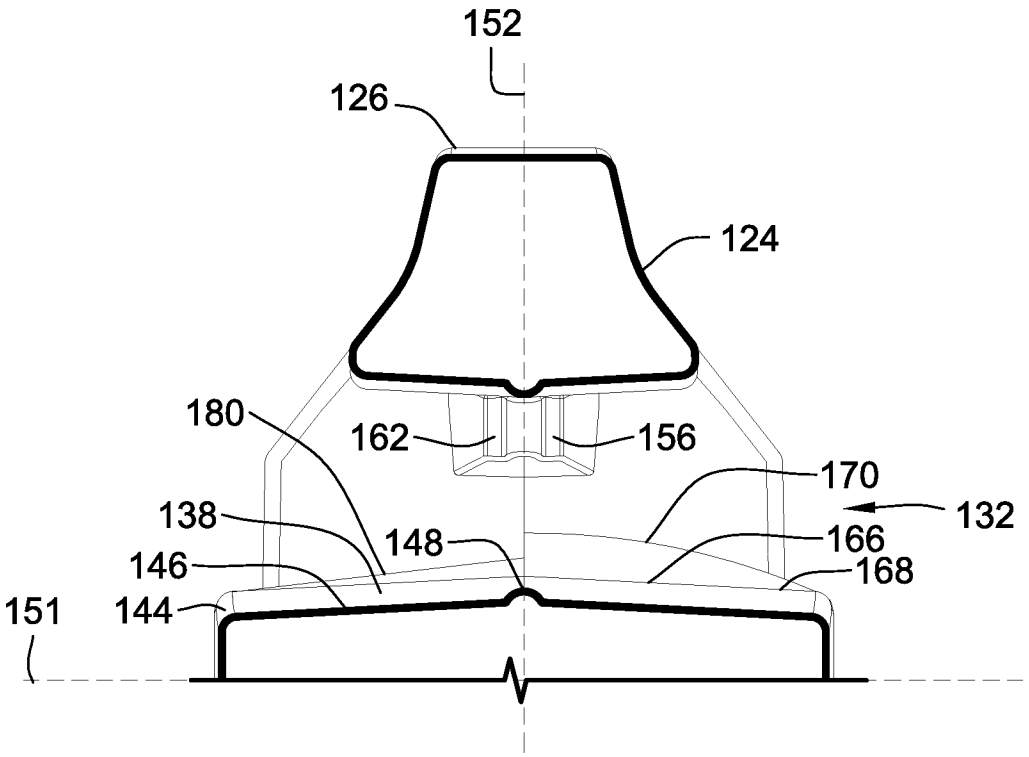
FIG. 7 is another front cross-sectional view of a container including an embodiment of the present invention.

Top wall 124 may be provided with a tubular recess 146. Tubular recess 146 may be shaped to receive portions of sprayer handle 200. Tubular recess 148 includes an upwardly-protruding snap lug 148 configured to engage a corresponding recess in head 208 of sprayer handle 200. As best shown in FIGS. 5 and 7, carrying handle 126 is provided with a downwardly protruding snap lug 149 vertically opposed to snap lug 148 and configured to engage a corresponding recess in head 208 of sprayer handle 200. In a preferred embodiment, snap lugs 148, 149 are located on the center plane of the container 100 and are vertically aligned along a line parallel to vertical axis 152.

In the embodiment shown, the left side 176 of top wall 124 extends from the center plane defined by center lines 150, 152 in the direction of side wall 112. Similarly, the right side 178 of top wall 124 extends from the center plane defined by center lines 150, 152 in the direction of side 110.

Left side 176 of top wall 124 includes a generally planar surface, here shown as the flat surface or plane defined panels by 166, 174. As shown, the generally planar surface of left side 176 is slightly lower towards the rear 130 of container 100. In a typical embodiment, the generally planar surface of left side 176 is sloped downward at an angle of about 4 degrees with respect to the horizontal plane defined by center lines 150, 151.

At transition zones 168, 172, top wall 124 is provided with a raised arch 170 panel extending upwards from the plane of top wall 124 defined by panels 166, 174. In the embodiment shown, raised arch panel 170 smoothly transitions from panels 166, 174. In other embodiments, transition zone 168 may be proximate to tubular recess 146, such that the there is little or no discrete panel 166 between tubular recess 146 and raised arch panel 170. In typical embodiments, the peak height of arch 170 above the plane defined by panels 166, 174 is between about 0.2 inch to 0.5 inch. In a preferred embodiment, the peak height of arch 170 above the plane defined by panels 166, 174 is between about 0.3 inch to 0.4 inch, and in a particularly preferred embodiment is 0.345 inches.

Right side 178 of top wall 124 also includes a generally planar surface, here shown as the flat surface or plane defined by panels 140, 141. As shown, the generally planar surface of right side 178 is slightly lower towards the rear 130 of container 100. In a typical embodiment, the generally planar surface of right side 178 is sloped downward at an angle of about 4 degrees with respect to the horizontal plane defined by center lines 150, 151.

A transverse wedge 180 extends from the center plane defined by center lines 150, 152 in the direction of side 110. In various embodiments, the width of transverse wedge 180 in the direction parallel to center line 150 is between about 0.25 inch to about 2.5 inches. In a preferred embodiment, the width of transverse wedge 180 in the direction parallel to center line 150 is between about 0.7 inch to about 0.8 inch. As shown, the height of transverse wedge 180 above top wall 140/141 proximate to the center plane is approximately 0.22 inch.

Figure 8:
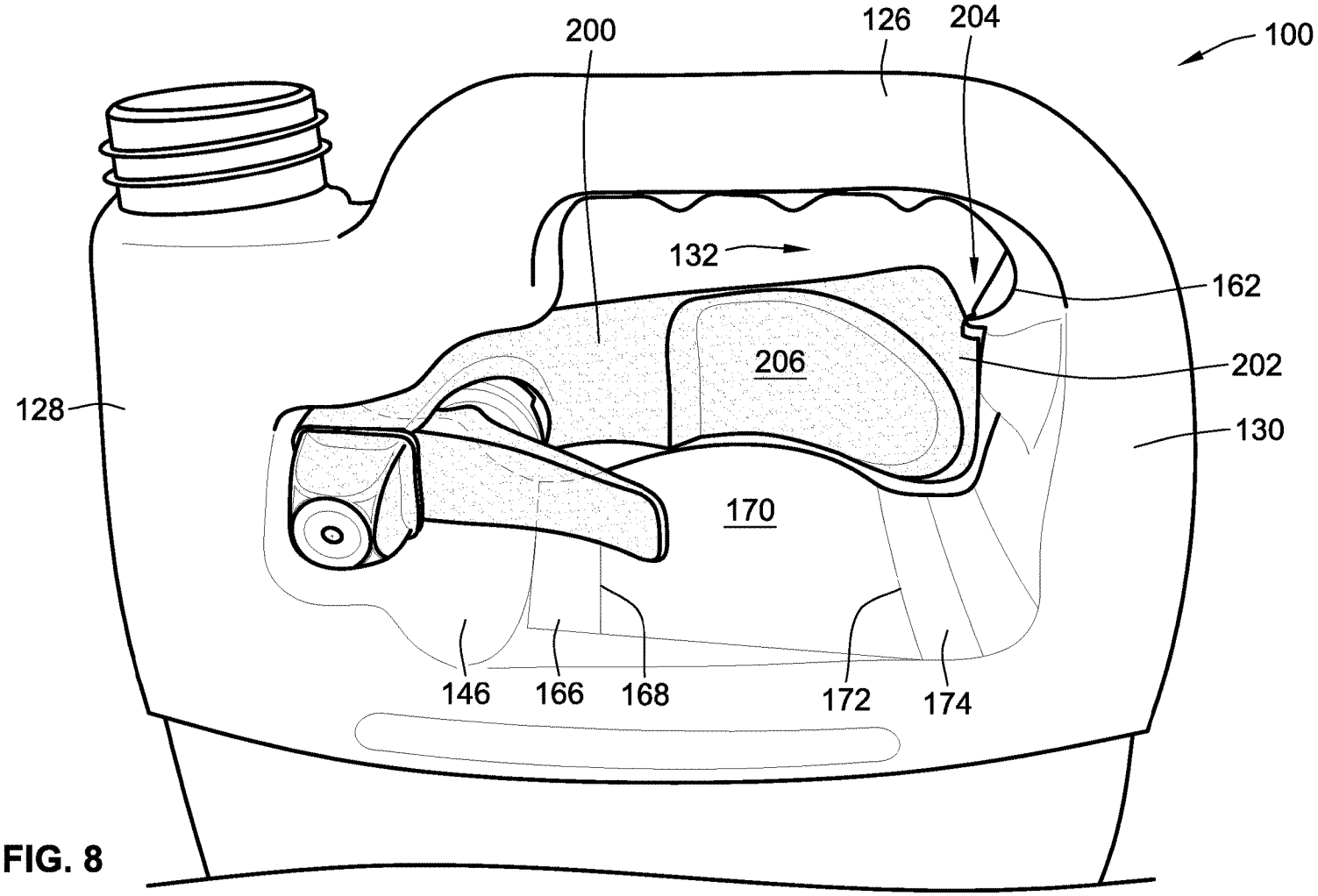
FIG. 8 is a perspective view of a container and nested sprayer handle according to the present invention.

In various embodiments, the maximum height of arch 170 is between about 0.1 inches to 0.4 inches higher than maximum height of transverse wedge 180 above top wall 124. In a preferred embodiment, the maximum height of arch 170 is between about 0.2 inches to 0.3 inches higher than maximum height of transverse wedge 180 above top wall 124. Generally, the maximum height of transverse wedge 180 is selected to allow nesting of grip portion 206 of sprayer handle 200 within handle opening 132 and above transverse wedge 180, as shown in FIG. 8.

In a preferred embodiment, transverse wedge 180 is positioned between panels 140, 141 such that each of panel 140, 141 have approximately the same width in the direction parallel to center line 150. In other embodiments, panel 140 may have a width greater or lesser than the width of panel 141 in the direction parallel to center line 150. In other embodiments, transverse wedge may be proximate to tubular recess 146, such that there is little or no discrete panel 140 between tubular recess 146 and raised transverse wedge 180. Alternatively, transverse wedge 180 may be positioned to the rear of container 100 and proximate to rear riser 130, such that there is little or no discrete panel 140 between rear riser 130 and transverse wedge 180.

As best shown in cross-sectional view of FIG. 7, the generally planar surface of the right side 178 defined by panels 140, 141 and the generally planar surface of the left side 176 defined by panels 166, 174 intersect at the center plane. In a preferred embodiment, panels 140 and 166 may intersect at a slight angle as shown. In another embodiment, panels 140 and 166, and the generally planar surfaces of sides 176, 178 may be co-planar.

In a preferred embodiment, sprayer handle 200 is removably secured within opening 132 by snap-fit, without provision of an adhesive, wire tie, tape, or other types of additional securement devices. In the exemplary embodiment show, sprayer handle 200 includes a bottom end 202 and a hand grip 206. Hand grip 206 may be hollow, to thereby allow storage of a connecting tube (not shown). The connecting tube may be used to removably couple sprayer handle 200 to threaded neck portion 120, to thereby facilitate spraying of the contents of container 100 via sprayer handle 200.

As best shown in FIG. 8, to snap-fit sprayer handle 200 within opening 132 of container 100, one or more lugs of container 100 are received by complementary recesses provided in sprayer handle 200. In the exemplary embodiment shown, a cylindrical lug 162 is received by lower complementary recess 204 positioned at the bottom end 202 of sprayer handle 200. Top end 208 of sprayer handle 200 further includes two upper complementary recesses (not shown) positioned on either side of top end 208 which are configured to receive lower snap lug 148 and upper snap lug 149. Accordingly, when upper recesses are engaged with snap lugs 148, 149 and lower recess is engaged with cylindrical lug 162, sprayer handle 200 will be securely positioned within opening 132 of container 100. When sprayer handle 200 is nested in opening 132 of container 100, sprayer head 208 is thereby mechanically held within opening 132 by engagement of snap lugs 148, 149 with sprayer head 208 of sprayer handle 200.

In alternate embodiments, container handle opening may be provided with recesses instead of lugs, and nested sprayer handle 200 may be provided with complementary lugs configure to snap fit into such recesses of the container handle opening. As will be appreciated by those of skill in the art, the container handle opening 132 and sprayer handle 200 may be provided with other types of complementary mechanical engagement portions to thereby allow a user to mechanically secure the sprayer handle 200 within container handle opening 132.

The three-dimensional structure of arch 170 and transverse wedge 180 of top wall 124 is configured to reduce or eliminate the deflection of top wall 124 inward and toward the internal volume of container 100, thereby minimizing flexure of handle opening 132. By reducing flexure of handle opening 132, the snap-fit tolerances provided to sprayer handle 200 are improved, thereby improving the retention of sprayer handle 200 by snap lugs 149, 148 and cylindrical lug 162, without the need for an additional securements such as a glue, adhesive, zip or wire tie, etc.

All references, including publications, patent applications, and patents cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A container comprising:

container walls defining an internal volume, the container walls including first and second side walls defining a center plane therebetween;

a top wall, wherein the top wall includes a first side and a second side positioned on opposite sides of the center plane, the first side and second side each having a generally planar surface, wherein the first side includes an arched panel extending from the center plane to the first side wall, and wherein the arched panel is located between two panels that define the generally planar surface of the first side;

a container handle, wherein the top wall and container handle define a handle opening;

wherein the handle opening is configured to receive and mechanically secure a sprayer handle.

2. The container of claim 1, wherein the arched panel extends above the generally planar surface of the first side proximate to the center plane.

3. The container of claim 1, wherein the second side includes a transverse wedge, the transverse wedge extending from the center plane to the second side wall, wherein the transverse wedge extends a first height above the generally planar surface of the second side proximate to the center plane.

4. A container comprising:

container walls defining an internal volume, the container walls including first and second side walls defining a center plane therebetween, a top wall, wherein the top wall includes a first side and a second side positioned on opposite sides of the center plane, the first side and second side each having a generally planar surface, and wherein the first side includes an arched panel;

a container handle, wherein the top wall and container handle define a handle opening;

wherein the handle opening is configured to receive and mechanically secure a sprayer handle;

wherein the second side includes a transverse wedge, the transverse wedge extending from the center plane to the second side wall, wherein the transverse wedge extends a first height above the generally planar surface of the second side proximate to the center plane; and wherein the transverse wedge extends a second height above the generally planar surface of the second side and proximate to the second side wall.

5. The container of claim 1, wherein the arched panel extends above the generally planar surface of the first side by about 0.2 inches to 0.5 inches proximate to the center plane.

6. The container of claim 1, wherein the container walls include a front wall, the first and second side walls, and a back wall, wherein the front wall, first and second side walls, and back wall are generally symmetrical about the center plane.

7. The container of claim 1, further comprising a lower snap lug and an upper snap lug, the lower snap lug and upper snap lug configured to engage the sprayer handle and mechanically secure the sprayer handle.

8. The container of claim 7, wherein the upper and lower snap lugs are positioned on the center plane.

9. The container of claim 7, further comprising a rear snap lug configured to engage the sprayer handle and mechanically secure the sprayer handle.

10. A dispensing system comprising:

a container, the container comprising:

container walls defining an internal volume;

a top wall, the top wall having a generally planar surface;

a container handle, wherein the top wall and container handle define a container handle opening;

an annular opening for providing access to the interior volume of the container; and a top wall arched portion extending above the generally planar surface, wherein the top wall arched portion is located between two panels that define the generally planar surface;

a sprayer handle assembly selectively securable to the container within the container handle opening, and to the annular opening.

11. The dispensing system of claim 10, further including a cylindrical recess extending below the generally planar surface.

12. The dispensing system of claim 10, wherein the container handle opening includes a first mechanical engagement portion and a second mechanical engagement portion.

13. The dispensing system of claim 12, wherein the sprayer handle includes a bottom end having a third mechanical engagement portion configured to engage the first mechanical engagement portion, and a top end having a fourth mechanical engagement portion configured to engage the second mechanical engagement portion.

14. The dispensing system of claim 13, wherein the container includes a center plane, and wherein the first mechanical engagement portion is positioned at the center plane.

15. The dispensing system of claim 13, wherein the container includes a center plane, and wherein the second mechanical engagement portion is positioned at the center plane.

16. A method for dispensing a product comprising:

providing a container, the container comprising:

a container handle opening, the container handle opening including a center plane, wherein the container handle opening further includes a first mechanical engagement portion;

a top wall, the top wall including a generally planar surface, an arched portion extending above the generally planar surface wherein the arched portion is on a first side of the center plane and is located between two panels that define the generally planar surface, and a transverse wedge portion wherein the transverse wedge portion is on a second side of the center plane;

providing a sprayer assembly, the sprayer assembly including at least a second mechanical engagement portion configured to engage the first mechanical engagement portion; and removably coupling the sprayer assembly to the container handle opening.

17. The method of claim 16, further comprising the step of filling the container with a liquid.

18. The method of claim 16, wherein the step of removably coupling a sprayer assembly to the container handle opening does not include a fastener or adhesive.

19. The method of claim 16, wherein removably coupling a sprayer assembly to the container handle opening further includes the step of engaging the first mechanical engagement portion to the second mechanical engagement portion.

20. The method of claim 19, wherein the first and second mechanical engagement portions comprise a protrusion and a complimentary recess.

21. The container of claim 1, further comprising a cylindrical recess extending below the generally planar surface.

22. The container of claim 21, wherein the arched panel is adjacent to the cylindrical recess on one side and wherein, on another side, the first side comprises a panel that defines the generally planar surface.

* * * * *